US007325508B2

(12) United States Patent
Boatman et al.

(10) Patent No.: US 7,325,508 B2
(45) Date of Patent: Feb. 5, 2008

(54) DUAL-AXIS CHAIN SUPPORT ASSEMBLY

(75) Inventors: L. Terry Boatman, Houston, TX (US); William L. Fontenot, Houston, TX (US); Roger D. Mickan, Sealy, TX (US)

(73) Assignee: SOFEC, Inc., Houston, TX (US)

( * ) Notice: Subject to any disclaimer, the term of this patent is extended or adjusted under 35 U.S.C. 154(b) by 0 days.

(21) Appl. No.: 11/089,287

(22) Filed: Mar. 24, 2005

(65) Prior Publication Data

US 2006/0213418 A1 Sep. 28, 2006

(51) Int. Cl.
*B63B 21/18* (2006.01)

(52) U.S. Cl. ..... 114/230.2; 114/180; 114/200; 114/293

(58) Field of Classification Search ..... 114/179, 114/180, 181, 199, 200, 293, 210, 230.2
See application file for complete search history.

(56) References Cited

U.S. PATENT DOCUMENTS 336,830 A * 2/1886 Winter ..... 114/180
3,289,626 A * 12/1966 Petrie et al. ..... 114/200
3,352,152 A * 11/1967 Abraham ..... 73/862.44
3,557,737 A 1/1971 Smulders
4,597,460 A * 7/1986 Wernimont ..... 177/211
5,441,008 A 8/1995 Lange
5,845,893 A * 12/1998 Groves ..... 254/389
6,439,146 B2 * 8/2002 Seaman et al. ..... 114/230.12
6,484,659 B2 11/2002 Hobdy et al.
6,663,320 B1 12/2003 Braud et al.
6,925,890 B2 * 8/2005 Fontenot ..... 73/828

FOREIGN PATENT DOCUMENTS

GB 2 351 058 A 12/2000

* cited by examiner

*Primary Examiner*—Sherman Basinger
(74) *Attorney, Agent, or Firm*—Henry C. Query, Jr.

(57) ABSTRACT

A support assembly for a mooring line of a floating vessel comprises a trunnion block which is pivotally supported on the vessel and a stopper block to which the mooring line is releasably secured. One of the trunnion block and the stopper block comprises a convex surface and the other of the trunnion block and the stopper block comprises a concave surface. In operation, the convex surface engages the concave surface to thereby pivotally support the stopper block on the trunnion block.

72 Claims, 6 Drawing Sheets

DUAL-AXIS CHAIN SUPPORT ASSEMBLY

BACKGROUND OF THE INVENTION

The present invention relates to a support assembly for connecting one or more mooring lines to a floating vessel, such as a loading buoy or a floating production storage and offloading ("FPSO") vessel. In particular, the invention relates to a support assembly which is pivotable about two generally perpendicular axes to thereby minimize bending fatigue on the mooring lines.

Mooring line support assemblies are commonly employed to releasably secure a mooring line to a floating vessel. For example, a chain support assembly is used to releasably secure an anchor chain to a vessel. However, when the vessel pitches and rolls, the anchor chain bends relative to the chain support assembly, and this bending can induce significant bending moments in the anchor chain which can cause it to fatigue and fail.

Therefore, prior art chain support assemblies often include means to pivotally connect the chain support assembly to the vessel so that the chain support assembly can oscillate about a horizontal axis. Although such chain support assemblies reduce the bending moments on the anchor chain in a direction perpendicular to this axis, they are not capable of reducing the bending moments on the anchor chain in a direction parallel to the axis. Therefore, a few chain support assemblies have been developed which allow them oscillate about two perpendicular horizontal axes. However, while these chain support assemblies are capable of significantly reducing the bending moments on the anchor chain, they are often complicated in design and, therefore, difficult and expensive to construct.

SUMMARY OF THE INVENTION

In accordance with the present invention, these and other disadvantages in the prior art are addresses by providing a support assembly for a mooring line of a vessel, the support assembly comprising a trunnion block which is pivotally supported on the vessel and a stopper block to which the mooring line is releasably secured, wherein one of the trunnion block and the stopper block comprises a convex surface and the other of the trunnion block and the stopper block comprises a concave surface, and wherein the convex surface engages the concave surface to thereby pivotally support the stopper block on the trunnion block.

In one embodiment of the invention, the convex surface comprises a first radius, the concave surface comprises a second radius, and the second radius is greater than the first radius. For example, the second radius may be greater than the first radius by a ratio of about 2.0 or more.

In another embodiment of the invention, the trunnion block comprises an opening through which the mooring line passes and two trunnion block rockers which are each positioned on a corresponding side of the opening. In addition, the stopper block comprises a through bore through which the mooring line passes and two stopper block rockers which are each positioned on a corresponding side of the through bore opposite a trunnion block rocker. Furthermore, each trunnion block rocker comprises one of the convex and the concave surfaces, and each stopper block rocker comprises the other of the convex and the concave surfaces.

In a further embodiment of the invention, at least one of the trunnion block rockers and the stopper block rockers comprises a separate insert which is received in a corresponding pocket in the trunnion block or the stopper block.

In yet another embodiment of the invention the support assembly comprises means for sensing a load on the mooring line. In one exemplary embodiment, the load sensing means comprises two load cell pins which are positioned in corresponding holes in one of the trunnion block rockers or the stopper block rockers. Also, the holes are ideally positioned such that a resultant force vector which is representative of the load passes between the load cell pins.

In addition, the support assembly may comprise means for unloading the load cell pins, such as a piston which in operation forces a portion of the trunnion block rocker or the stopper block rocker that is located above the load cell pins apart from a portion of the trunnion block rocker or the stopper block rocker that is located below the load cell pins.

In still another embodiment of the invention, the load sensing means comprises at least two conventional strain gages, each of which is mounted adjacent an opposite end of an elongated portion of the trunnion block rocker or the stopper block rocker which comprises a constant cross section. For example, the load sensing means may comprise four strain gages, each of which is mounted to a respective side of the trunnion block rocker or the stopper block rocker adjacent an opposite end of the elongated portion. Furthermore, each strain gage may be mounted in a corresponding relief groove which is formed in a side of the trunnion block rocker or the stopper block rocker.

Thus, the support assembly of the present invention provides a relatively simple mechanism for releasably securing a mooring line, such as an anchor chain, to a floating vessel. In addition, the support assembly is pivotable about two axis, and when these axes are oriented generally perpendicular to each other, the support assembly is able to pivot in virtually any direction in the plane which is parallel to both of these axes. Consequently, the links of the anchor chain which are positioned in the support assembly will remain in alignment, which will reduce or eliminate the bending moments on these links that could otherwise cause them to fatigue and fail.

These and other objects and advantages of the present invention will be made apparent from the following detailed description, with reference to the accompanying drawings. In the drawings, the same reference numbers may be used to denote similar components in the various embodiments.

DETAILED DESCRIPTION OF THE PREFERRED EMBODIMENTS

The support assembly of the present invention is designed to facilitate the connection of a mooring line to a floating vessel, such as a loading buoy or an FPSO. In addition, the support assembly can be used with any of a variety of mooring lines, including anchor chains and cables. For purposes of simplicity, however, the present invention will be described below in the context of a chain support assembly which is used to facilitate the connection of an anchor chain to the floating vessel.

Figure 1:
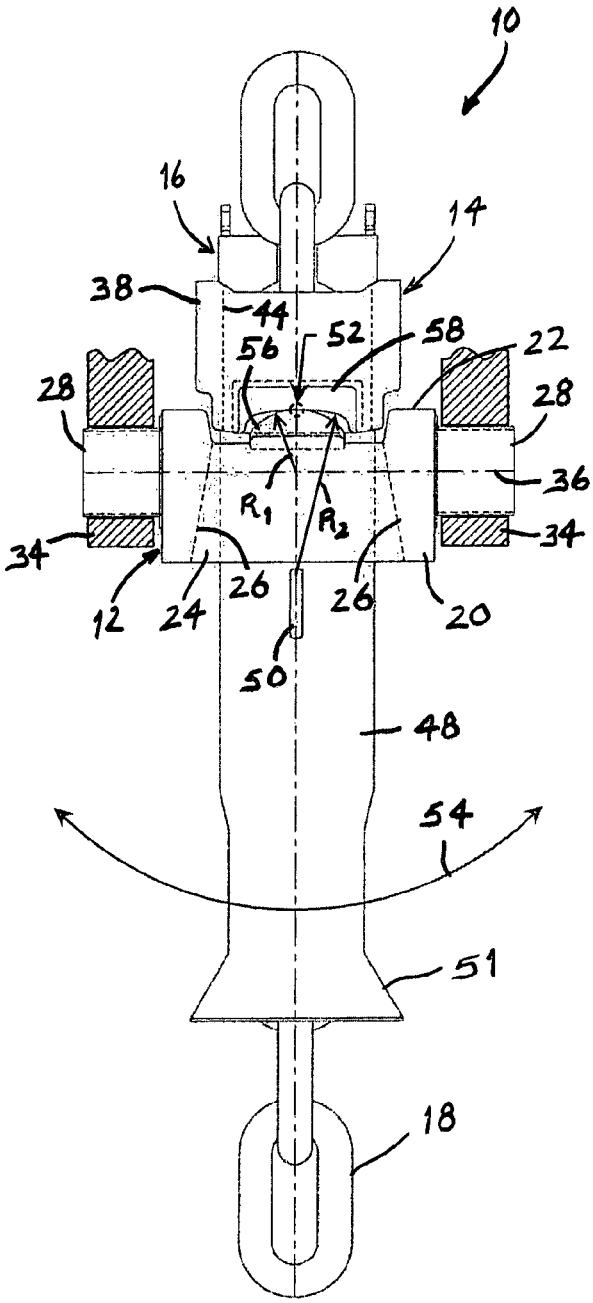
FIG. 1 is a front plan view of one embodiment of the support assembly of the present invention.
Figure 2:
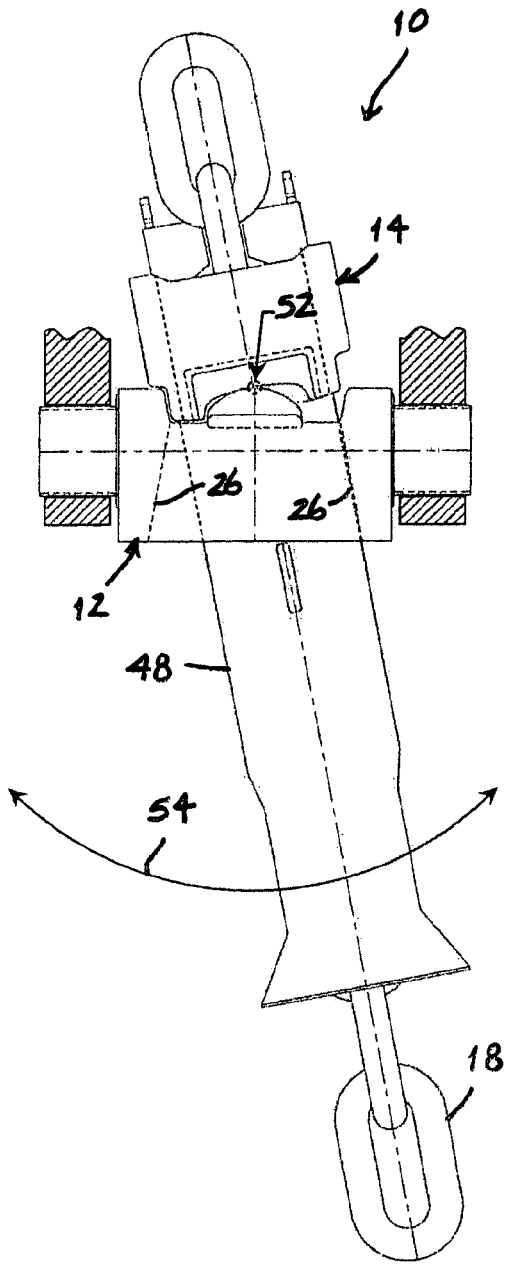
FIG. 2 is a front plan view of the support assembly of FIG. 1 in which the stopper block component of the invention is shown oriented at an angle relative to the trunnion block component of the invention.

Referring to FIGS. 1 and 2, the chain stopper assembly of the present invention, which is indicated generally by reference number 10, is shown to comprise a trunnion block 12 which is pivotally supported on the vessel (not shown), and a stopper block 14 which is pivotally supported on the trunnion block. The stopper block 14 may include a conventional chain stopper 16, such as a ratcheting-type chain stopper, which releasably engages an anchor chain 18 to thereby secure the anchor chain to the vessel. As will be described more fully below, the trunnion block 12 and the stopper block 14 are pivotable about two generally perpendicular axes to thereby allow the successive links of the anchor chain 18 to remain in alignment, which will reduce or eliminate bending moments on the links that could otherwise cause the anchor chain to fatigue and fail.

Figure 3:
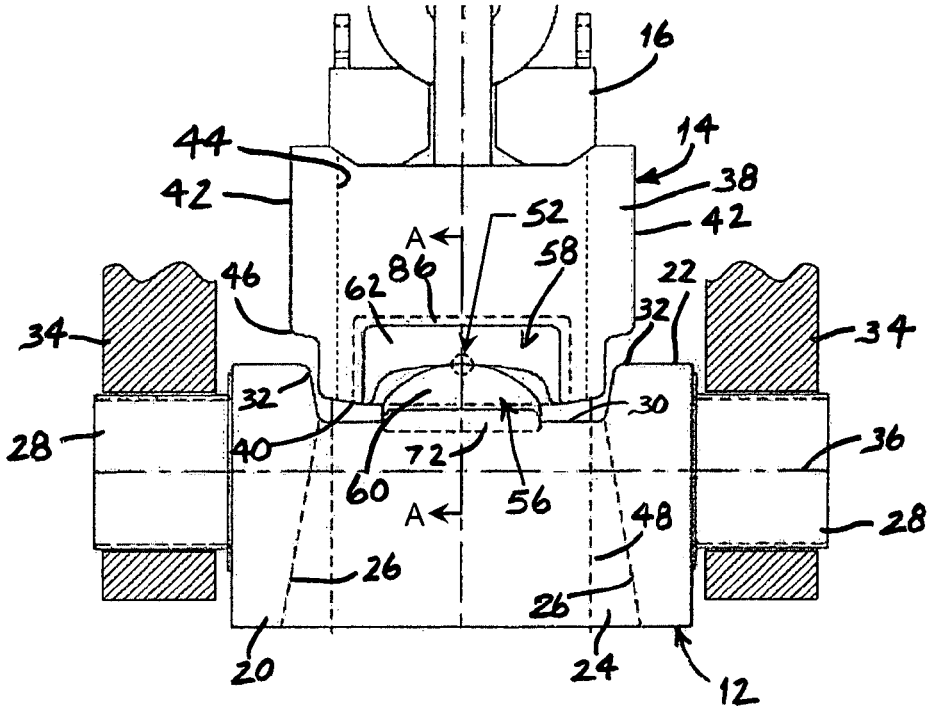
FIG. 3 is an enlarged view of the trunnion block and stopper block components of the support assembly shown in FIG. 1.

As best seen in FIG. 3, the trunnion block 12 includes a trunnion body 20 which comprises an upper surface 22, an opening 24 which extends through the trunnion body and includes at least two downwardly diverging sidewalls 26, a pair of cylindrical projections 28 which extend from opposite ends of the body, and preferably also a recess 30 which is formed in the upper surface and which defines a pair of upstanding shoulders 32. The projections 28 are rotatably connected to a support structure 34, such as a chain table (not shown), which in turn is connected to the vessel. Thus, the trunnion block 12 is pivotable about an axis 36 relative to the support structure 34.

The stopper block 14 includes a stopper body 38 which comprises a lower surface 40, a pair of sidewalls 42 and, in an exemplary embodiment of the invention, an axial through bore 44 through which the anchor chain 18 is allowed to pass. The sidewalls 42 may be recessed adjacent the lower surface 40 to thereby define a pair of abutments 46, the purpose of which will be made apparent below. Furthermore, as shown in FIGS. 1 and 2, the stopper block 14 may be connected to or formed integrally with a conventional chain tube 48 through which the anchor 18 chain passes.

During assembly of the chain stopper assembly 10, the stopper block 14 and its depending chain tube 48 are inserted into the opening 24 in the trunnion block 12, the anchor chain 18 is guided through the stopper block and the chain tube, and the chain stopper 16 is installed over the anchor chain and lowered into the stopper block to thereby secure the anchor chain to the vessel. In order to prevent the stopper block 14 from separating from the trunnion block 12 as the anchor chain 18 is being pulled in, the chain tube 48 may be provided with a suitable uplift retainer 50, such as a piece of steel plate which is welded or otherwise attached to the chain tube after the trunnion block and the stopper block are assembled together. In addition, although not required for the present invention, the chain tube may comprise a bell mouth 51 which is welded or otherwise attached to the chain tube after the trunnion block 12 and the stopper blocks 14 are assembled together.

In accordance with the present invention, the stopper block 14 is supported on the trunnion block 12 so as to be pivotable about an axis 52 in the direction of the of the arrow 54 shown in FIGS. 1 and 2. This is accomplished in one embodiment of the invention by providing the trunnion block 12 with a pair of trunnion block rockers 56 and the stopper block 14 with a pair of stopper block rockers 58 which pivotally engage the trunnion block rockers. In an exemplary embodiment of the invention, each trunnion block rocker 56 (only one of which is visible in FIGS. 1 through 3) comprises a generally semi-cylindrical, convex projection which extends upwardly from the upper surface 22 of the trunnion block body 20 on a corresponding side of the opening 24. In addition, each stopper block rocker 58 (only one of which is visible in FIGS. 1 through 3) comprises a generally semi-cylindrical, concave depression which is formed in the bottom surface 40 of the stopper block body 38 on a corresponding side of the through bore 44. However, one can readily appreciate that, instead of the configuration just described, the trunnion block rockers 56 could comprise concave depressions which are formed in the upper surface 22 of the trunnion block body 20, and the stopper block rockers 58 could comprise convex projections which extend downwardly from the bottom surface 40 of the stopper block body 38.

As shown in FIG. 1, the trunnion block rockers 56 comprise a radius $R_1$ and the stopper block rockers 58 comprise a radius $R_2$. Although these two radii could be the same, the radius $R_2$ is ideally greater than the radius $R_1$ to ensure that the stopper block rockers 58 will roll without slipping relative to the trunnion block rockers 56 as the stopper block 14 pivots about the axis 52. In one embodiment of the invention, the radius $R_2$ is greater than the radius $R_1$ by a ratio of about 2.0 or more. Accordingly, as the stopper block rockers 58 pivot over the trunnion block rockers 56, the axis 52 may actually translate along the curve of the trunnion block rockers, although it will remain generally parallel to the position in which it is depicted in the Figures.

The trunnion block rockers 56 and the stopper block rockers 58 may be formed integrally with the trunnion block 12 and the stopper block 14, respectively. Alternatively, the trunnion block rockers 56 and the stopper block rockers 58 may be formed from separate members which are attached such as by welding to the trunnion block 12 and the stopper block 14. However, in an exemplary embodiment of the invention, the trunnion block rockers 56 and the stopper block rockers 58 are formed from separate inserts 60 and 62, respectively, which are preferably made from a suitable material, such as a high strength alloy steal, that may be machined or cast to the desired shape.

Figure 4:
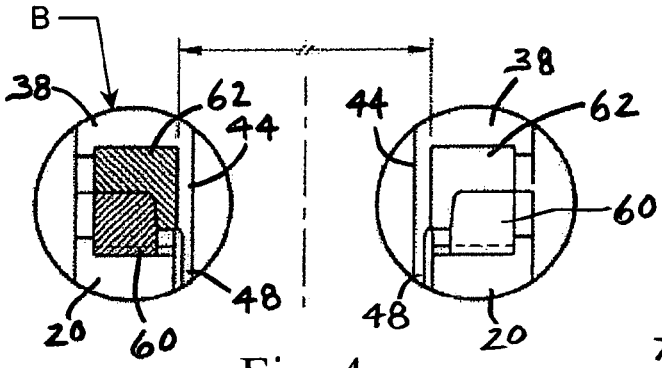
FIG. 4 is a partial cross sectional view of the support assembly taken along line A-A of FIG. 3.
Figure 5:
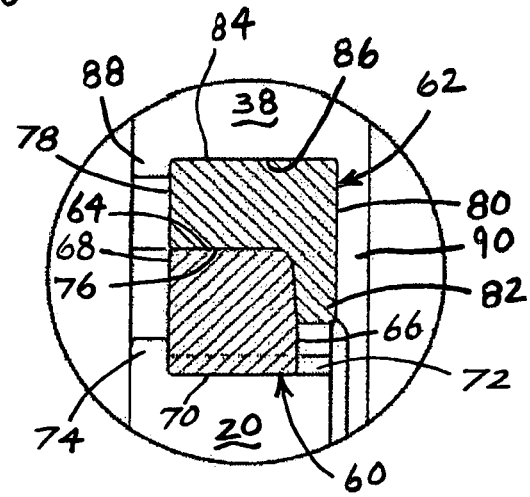
FIG. 5 is an enlarged view of the portion of the support assembly indicated at B in FIG. 4.

Referring to FIGS. 3 through 5, each trunnion block insert 60 comprises a convex upper surface 64, an inner sidewall 66, an outer sidewall 68 and a bottom portion 70 which is received in a corresponding pocket 72 that is formed in the upper surface 22 of the trunnion block body 20. Each pocket 72 includes an outer retainer lip 74 which engages the outer sidewall 68 to prevent the trunnion block insert 60 from moving laterally outwardly relative to the trunnion block body 20. In addition, the trunnion block insert 60 and the pocket 72 are preferably dimensioned so that the trunnion block insert will remain fixed in place in the pocket without the need for separate attachment means, such as welding or mechanical fasteners.

Each stopper block insert 62 comprises a concave lower surface 76 which pivotally engages the upper surface 64 of its corresponding trunnion block insert 60, an exterior sidewall 78, an interior sidewall 80, a downwardly depending lip 82 which engages the inner sidewall 66 of the trunnion block insert, and a rectilinear peripheral surface 84 which is received in a corresponding pocket 86 that is formed in the bottom surface 40 of the stopper block body 38. Each pocket 86 includes an overhang portion 88 which engages the exterior sidewall 78 and an inner retainer wall 90 which engages the interior sidewall 80 to prevent the stopper block insert 62 from moving laterally relative to the stopper block body 38. In addition, like the trunnion block insert 60, the stopper block insert 62 and the pocket 86 are preferably dimensioned so that the stopper block insert will remain fixed in place in the pocket without the need for separate attachment means, such as welding or mechanical fasteners.

The interfit between the trunnion block inserts 60 and their corresponding stopper block inserts 62 permits the stopper block 14 to pivot freely about the axis 52 but prevents the stopper block from moving laterally relative to the trunnion block 12. Any loads acting parallel to the axis 52 will instead cause the trunnion block 12, and thus also the stopper block 14, to pivot about the axis 36. The degree to which the stopper block 14 can pivot relative to the trunnion block 12 is ideally limited by the engagement between the abutments 46 on the stopper block body 38 and the shoulders 32 on the trunnion block body 20. Moreover, the downwardly diverging configuration of the sidewalls 26 in the opening 24 of the trunnion block 12 will ensure that the chain tube 48 does not interfere with the pivoting of the stopper block 14.

Thus, the chain stopper assembly 10 is capable of pivoting about both the axes 36 and 52 under the influence of mooring loads acting on the anchor chain 18. Moreover, since the axes 36 and 52 are ideally generally perpendicular, the chain stopper assembly 10 can pivot in virtually any direction in the plane which is parallel to both of these axes. Consequently, the links of the anchor chain 18 which are positioned in the stopper block 14 will remain in alignment, which will reduce or eliminate the bending moments on these links that could otherwise cause them to fatigue and fail.

Figure 6:
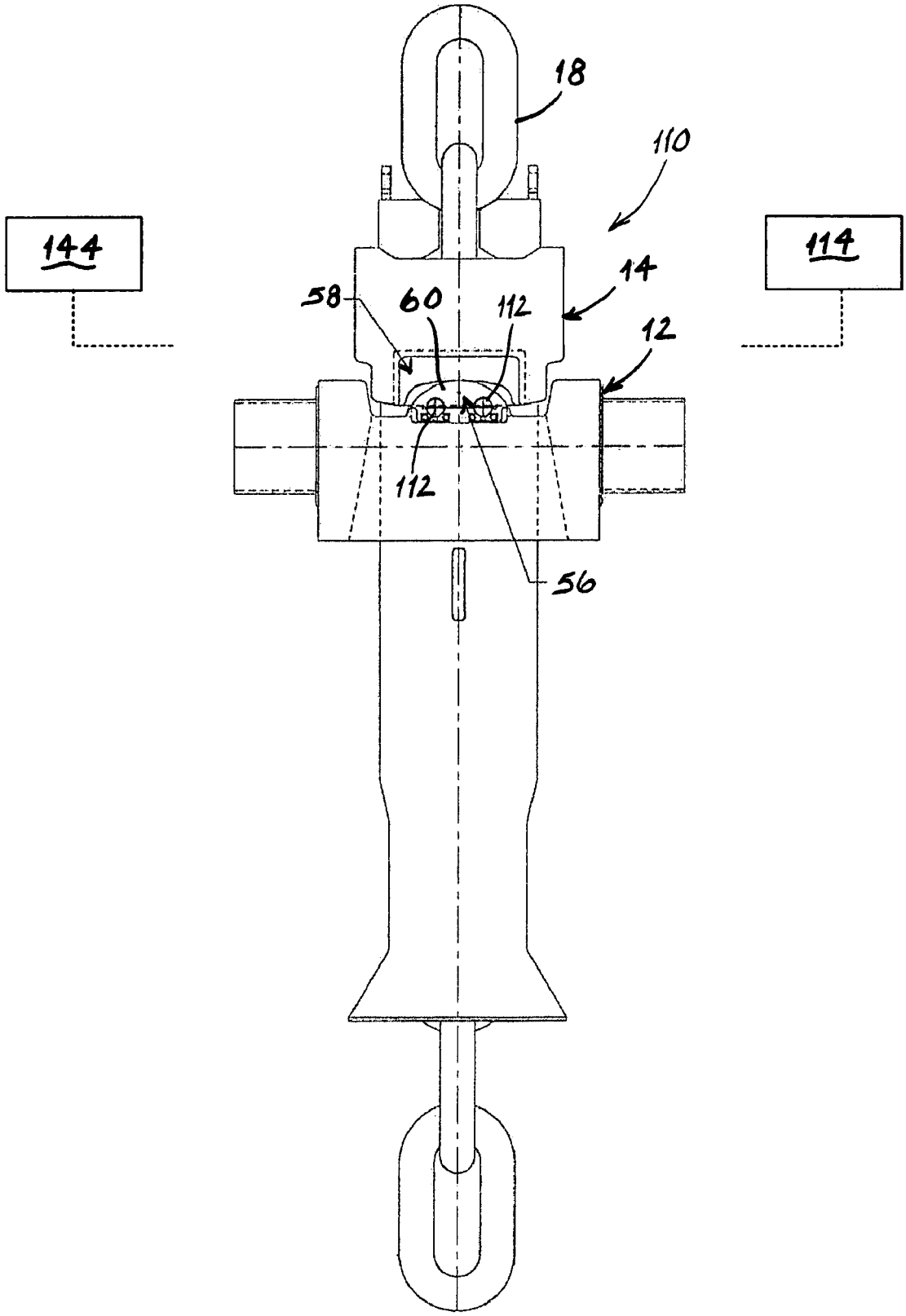
FIG. 6 is a front plan view of another embodiment of the support assembly of the present invention.

In accordance with another embodiment of the invention which is shown in FIG. 6, the chain stopper assembly, generally 110, comprises means for sensing the load on the anchor chain 18. The load sensing means, the specific embodiments of which will be described below, may be located in the trunnion block 12 or the stopper block 14. For example, the load sensing means may be located in one or both of the trunnion block rockers 56, in one or both of the stopper block rockers 58, or in any combination of the trunnion block rockers and the stopper block rockers.

Figure 7:
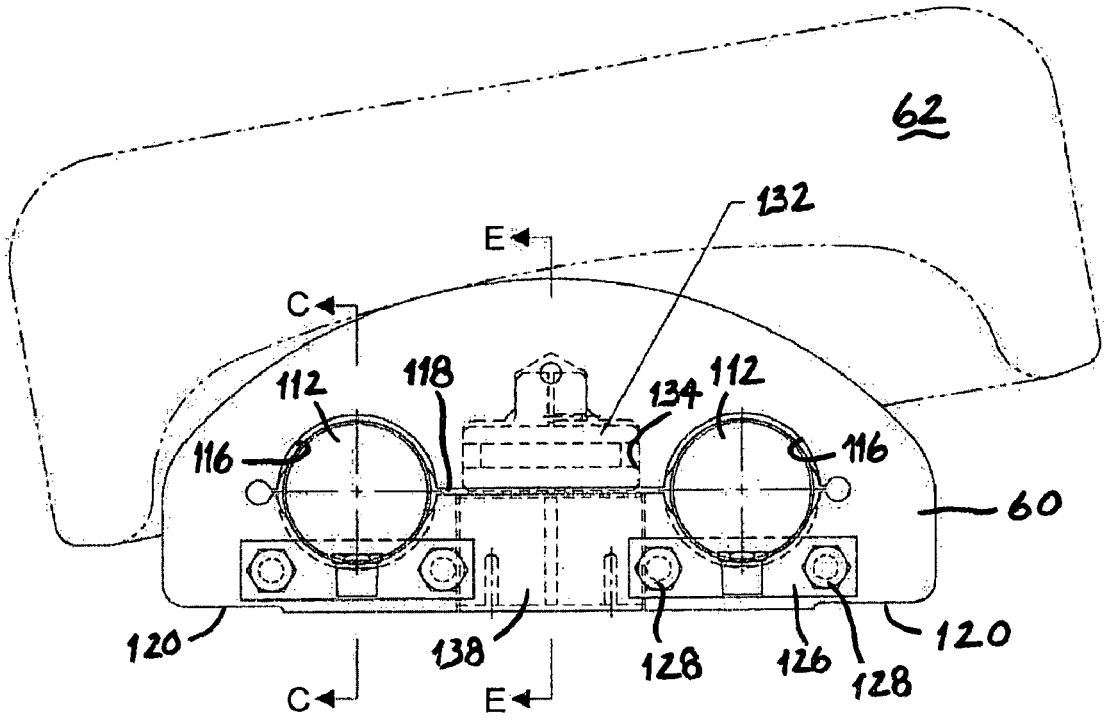
FIG. 7 is an enlarged front plan view of the trunnion block insert component of the support assembly shown in FIG. 6.
Figure 8:
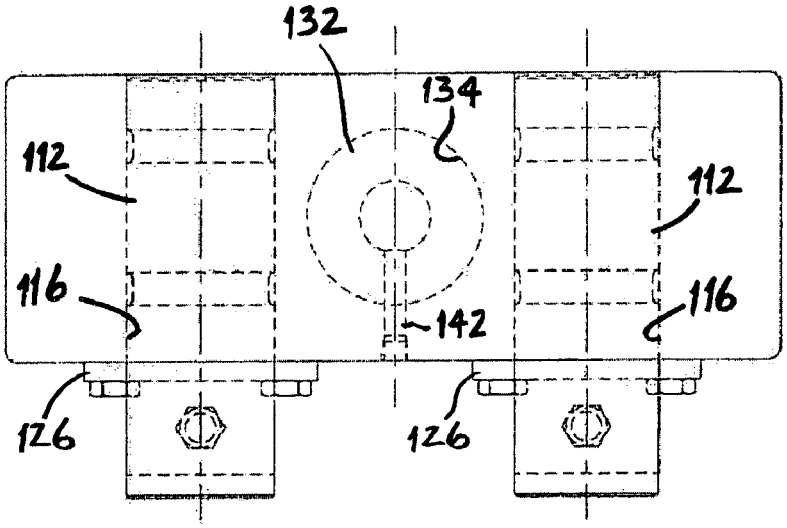
FIG. 8 is an enlarged top plan view of the trunnion block insert component of the support assembly shown in FIG. 6.

Referring to FIGS. 7 through 10, the load sensing means of an exemplary embodiment of the invention comprises a number of conventional load cell pins 112 which are mounted in a corresponding trunnion block insert 60. In the embodiment of the invention which is shown in FIG. 7, the load sensing means comprises two load cell pins 112 which are mounted in the trunnion block insert 60. Although not shown in the drawings, the load sensing means may also comprise a number of additional load cell pins 112 which are mounted in the other trunnion block insert 60. Alternatively or in addition to this arrangement, the load sensing means may comprise a number of load cell pins 112 which are mounted in one or both of the stopper block inserts 62. In this regard, the number and arrangement of the load cell pins 112 in the trunnion block inserts 60 and the stopper block inserts 62 can be varied to meet the particular requirements of the chain stopper assembly 110.

Where as shown in FIG. 7 the load sensing means comprises two load cell pins 112 in a single trunnion block insert 60, the signals from each load cell pin are transmitted to a conventional signal processor 114 (FIG. 6), which combines these signals to determine the total load acting on that trunnion block insert. The signal processor 114 then multiplies this total load by two to determine the overall load acting on the trunnion block 12, which is representative of the load on the anchor chain 18. If, however, the load sensing means comprises a pair of load cell pins 112 in each of the trunnion block inserts 60, the signal processor combines the signals from each pair of load cell pins to determine the total load acting on each trunnion block insert, and then adds these total loads together to determine the overall load acting on the trunnion block 12. The overall load acting on the trunnion block 12 can similarly be determined for other numbers and arrangements of load cell pins 112.

Figure 9:
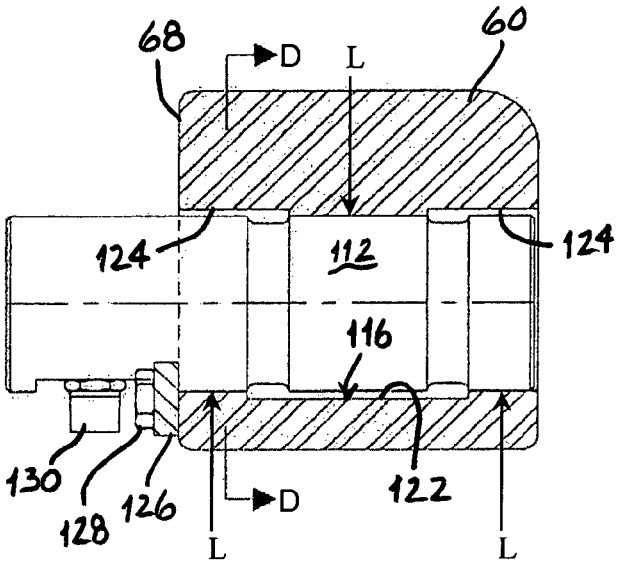
FIG. 9 is a cross sectional view of the trunnion block insert taken along line C-C of FIG. 7.
Figure 10:
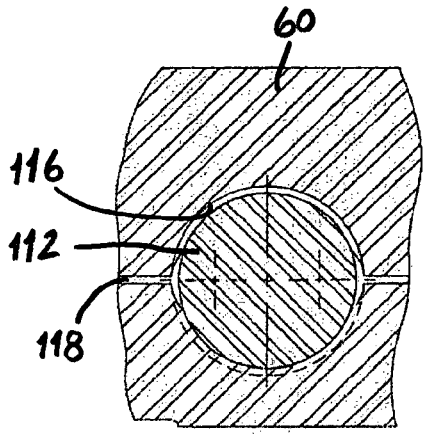
FIG. 10 is a cross sectional view of the trunnion block insert taken along line D-D of FIG. 9.

Referring still to FIGS. 7 through 10, each load cell pin 112 is positioned in a corresponding hole 116 that ideally extends transversely into or completely through the trunnion block insert 60. When the load sensing means comprises two load cell pins 112, the holes 116 are ideally located sufficiently far apart so that a resultant force vector which is representative of the load on the anchor chain 18 passes between the load cell pins. In addition, the trunnion block insert 60 may include a transverse relief groove 118 which extends through the trunnion block insert between the holes 116, and the ends of the bottom portion 70 of the trunnion block insert may be relieved as at 120, to ensure that the load is transmitted through the load cell pins 112. Furthermore, as shown in FIG. 9, each hole 116 may comprise an eccentrically enlarged middle diameter portion 122 and two eccentrically enlarged end diameter portions 124 which are diametrically opposed to the enlarged middle diameter portion. This will ensure that the load cell pin 112 is placed in a three-point loading arrangement, which is represented by the arrows L in FIG. 9, if the particular design of the load cell pin so requires.

In an exemplary embodiment of the invention, each load cell pin 112 is a self-contained device which is retained in its corresponding hole 116 by a retainer plate 126 that is secured to the outer sidewall 68 of the trunnion block insert 60 with, for example, a number of screws 128. Accordingly, the load cell pins 112 may be removed and replaced if necessary. In addition, each load cell pin 112 preferably extends slightly beyond the outer sidewall 68 of the trunnion block insert 60 to accommodate a nipple 130 through which the wires leading to the signal processor 114 may be routed.

Figure 11:
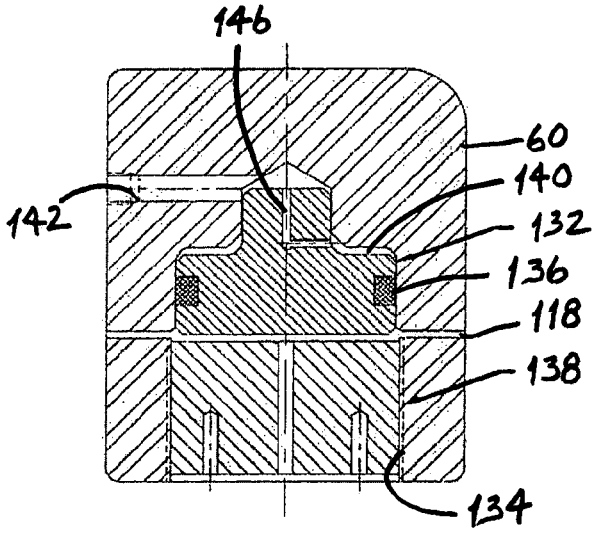
FIG. 11 is a cross sectional view of the trunnion block insert taken along line E-E of FIG. 7.

The chain support assembly 110 may also comprise means for unloading the load cell pins 112 to allow them to be easily removed and replaced. Referring to FIGS. 7 and 11, for example, the chain support assembly 110 may comprise a hydraulic piston 132 which is positioned in a centrally-located bore 134 in the trunnion block insert 60, a suitable seal 136 which is received in a corresponding groove in the piston and which sealingly engages the bore, and preferably also a reaction plug 138 which is secured within the bore below the piston. In one embodiment of the invention, the piston 132 is located above the relief groove 118 and the reaction plug 138 is located below the relief groove. In addition, a piston chamber 140 is located within the bore 134 above the seal 136, and this chamber is connected through a port 142 in the trunnion block insert 60 with a source of hydraulic pressure 144 (FIG. 6). In an exemplary embodiment of the invention, the piston chamber 140 may comprise both a reduced diameter portion which is connected to the port 142 and an enlarged diameter portion which is connected to the reduced diameter portion by a hole 146 that extends through the piston 132.

In operation, hydraulic pressure is communicated to the piston chamber 140 to force the piston 132 downward against the reaction plug 138. This causes the potion of the trunnion block insert 60 which is located above the relief groove 118 to move apart from the portion of the trunnion block insert which is located below the relief groove. This in turn will relieve the load on the load pins 112 and allow them to be easily removed from their corresponding holes 116.

Figure 12:
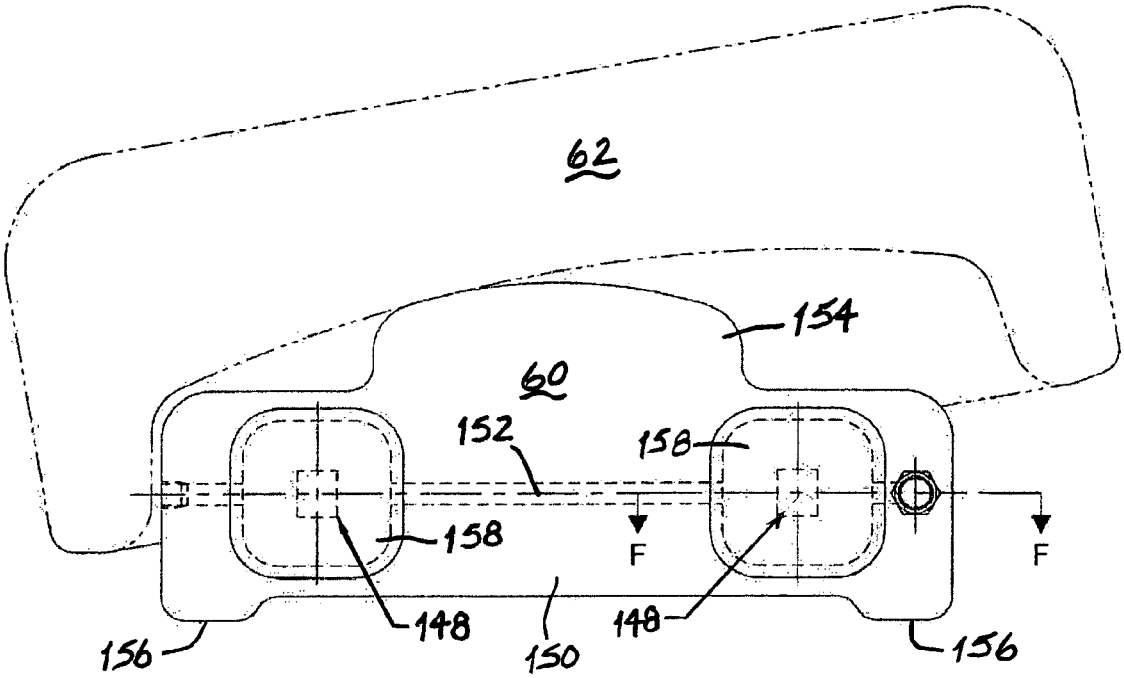
FIG. 12 is an enlarged front plan view of the trunnion block insert component of another embodiment of the support assembly of the present invention.
Figure 13:
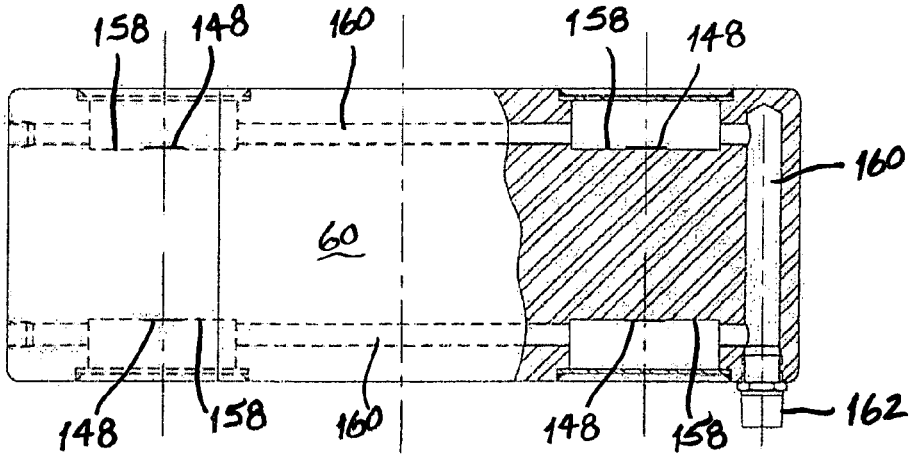
FIG. 13 is a cross sectional view of the trunnion block insert taken along line F-F of FIG. 12.

As an alternative to the self-contained load cell pins 112, the load sensing means could comprise a number of load sensors which are mounted to or formed integrally with one or both of the trunnion block rockers 56, with one or both of the stopper block rockers 58, or with any combination of trunnion block rockers and stopper block rockers. Referring to FIGS. 12 and 13, for example, the load sensing means is shown to comprise a number of conventional strain gages 148, such as ordinary shear-type strain gages, which are mounted to a corresponding trunnion block insert 60. Although not illustrated in the drawings, the load sensing means may also comprise a number of additional strain gages which are mounted to the other trunnion block insert 60. Alternatively or in addition to this arrangement, the load sensing means may comprise a number of strain gages which are mounted to one or both of the stopper block inserts 62. In this regard, the number and arrangement of strain gages on the trunnion block inserts 60 and the stopper block inserts 62 can be varied to meet the particular requirements of the chain stopper assembly 110.

In the exemplary embodiment of the invention shown in FIGS. 12 and 13, the load sensing means comprises four strain gages 148 which are mounted to a corresponding trunnion block insert. In addition, the trunnion block insert 60 is ideally configured as a shear beam load cell which is placed in a three-point loading arrangement. Accordingly, the trunnion block insert 60 includes an elongated body portion 150 which comprises a substantially constant cross section perpendicular to its longitudinal axis 152, a convex head portion 154 which projects above the body portion, and two foot portions 156 which depend downwardly from opposite ends of the body portion. In this three-point loading arrangement, the load from the anchor chain 18 will be transmitted through the body portion 150 from the head portion 154 to the foot portions 156.

The strain gages 148 are ideally located in the area of constant cross section in the body portion 150 of the trunnion block insert 60. In the embodiment of the invention which is shown in FIGS. 12 and 13, for example, each strain gage 148 is located on a respective side of the trunnion block insert 60 adjacent an opposite end of the body portion 150. In addition, the strain gages 148 on each side of the trunnion block insert 60 are ideally positioned sufficiently far apart so that a resultant force vector which is representative of the load passes between them. In this manner, the strains which are measured at each end of the body portion 150 may be added together to determine the total load on the insert 60 regardless of the point of application of the load.

Also, each strain gage 148 may be mounted in a corresponding relief groove 158 in the side of the insert 60 which is sufficiently deep to result in shear strains that are large enough to be measured accurately. In this event, the relief grooves 158 are ideally covered and sealed to protect the strain gages 148. Furthermore, the wires from each strain gage 148 may be routed through one or more channels 160 which extend through the insert 60. These channels 160 may also be connected to a nipple 162 through which the wires are connected to the signal processor 114.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

What is claimed is:

1. In combination with a floating vessel which includes at least one mooring line for securing the vessel to the sea floor, the improvement comprising a support assembly for the mooring line which comprises:

a trunnion block which is pivotally supported on the vessel;

a stopper block to which the mooring line is releasably secured;

wherein one of the trunnion block and the stopper block comprises a generally semi-cylindrical convex surface and the other of the trunnion block and the stopper block comprises a generally semi-cylindrical concave surface;

wherein the convex surface engages the concave surface to thereby pivotally support the stopper block on the trunnion block about a single pivot axis; and wherein the convex surface comprises a first radius, the concave surface comprises a second radius, and the second radius is greater than the first radius.

2. The combination of claim 1, wherein the second radius is greater than the first radius by a ratio of about 2.0 or more.

3. The combination of claim 1, wherein the support assembly further comprises means for sensing a load on the mooring line.

4. The combination of claim 3, wherein the load sensing means comprises at least one load cell pin which is supported on the trunnion block or the stopper block.

5. The combination of claim 3, wherein the load sensing means comprises at least one strain gage which is mounted on the trunnion block or the stopper block.

6. In combination with a floating vessel which includes at least one mooring line for securing the vessel to the sea floor, the improvement comprising a support assembly for the mooring line which comprises:

a trunnion block which is pivotally supported on the vessel;

a stopper block to which the mooring line is releasably secured;

wherein one of the trunnion block and the stopper block comprises a convex surface and the other of the twnnfon block and the stopper block comprises a concave surface;

wherein the convex surface engages the concave surface to thereby pivotally support the stopper block on the trunnion block; and wherein the trunnion block further comprises:

an opening through which the mooring line passes; and two trunnion block rockers, each of which is positioned on a corresponding side of the opening;

wherein each trunnion block rocker comprises one of the convex and the concave surfaces.

7. The combination of claim 6, wherein the stopper block further comprises:

a through bore through which the mooring line passes; and two stopper block rockers, each of which is positioned on a corresponding side of the through bore opposite a trunnion block rocker;

wherein each stopper block rocker comprises the other of the convex and the concave surfaces.

8. The combination of claim 7, wherein the support assembly further comprises means for sensing a load on the mooring line.

9. The combination of claim 8, wherein the load sensing means comprises at least one load cell pin which is positioned in a corresponding hole in the trunnion block rocker or the stopper block rocker.

10. The combination of claim 9, wherein the load sensing means comprises at least two load cell pins which are positioned in corresponding holes in one of the trunnion block rockers or the stopper block rockers.

11. The combination of claim 10, wherein the holes are positioned such that a resultant force vector which is representative of the load passes between the load cell pins.

12. The combination of claim 10, further comprising a relief groove which extends through the trunnion block rocker or the stopper block rocker between the holes.

13. The combination of claim 9, wherein the hole is configured to engage the load cell pin in a three-point loading arrangement.

14. The combination of claim 9, wherein the load cell pin is removably mounted in the hole.

15. The combination of claim 9, further comprising means for unloading the load cell pin.

16. The combination of claim 15, wherein the unloading means comprises at least one piston which in operation forces a portion of the trunnion block rocker or the stopper block rocker that is located above the load cell pin apart from a portion of the trunnion block rocker or the stopper block rocker that is located below the load cell pin.

17. The combination of claim 8, wherein the load sensing means comprises at least one strain gage which is mounted to at least one of the trunnion block rockers and the stopper block rockers.

18. The combination of claim 17, wherein the load sensing means comprises at least two strain gages, each of which is mounted adjacent an opposite end of an elongated portion of the trunnion block rocker or the stopper block rocker which comprises a constant cross section.

19. The combination of claim 18, wherein the load sensing means comprises at least four strain gages, each of which is mounted to a respective side of the trunnion block rocker or the stopper block rocker adjacent an opposite end of the elongated portion.

20. The combination of claim 18, wherein each strain gage is mounted in a corresponding relief groove which is formed in a side of the trunnion block rocker or the stopper block rocker.

21. The combination of claim 18, wherein the trunnion block rocker or the stopper block rocker is configured such that the elongated portion is placed in three-point loading.

22. The combination of claim 7, wherein at least one of the trunnion block rockers and the stopper block rockers comprises a separate insert which is received in a corresponding pocket in the trunnion block or the stopper block.

23. The combination of claim 22, wherein at least each of the trunnion block rockers or each of the stopper block rockers comprises a separate insert which is received in a corresponding pocket in the trunnion block or the stopper block.

24. The combination of claim 22, wherein each of the trunnion block rockers comprises a separate insert which is received in a corresponding pocket in the trunnion block and each of the stopper block rockers comprises a separate insert which is received in a corresponding pocket in the stopper block.

25. The combination of claim 22, wherein the support assembly further comprises means for sensing a load on the mooring line.

26. The combination of claim 25, wherein the load sensing means comprises at least one load cell pin which is positioned in a corresponding hole in the insert.

27. The combination of claim 26, wherein the load sensing means comprises two load cell pins which are mounted in corresponding holes in the insert.

28. The combination of claim 27, wherein the holes are positioned such that a resultant force vector which is representative of the load passes between the load cell pins.

29. The combination of claim 27, further comprising a relief groove which extends through the insert between the holes.

30. The combination of claim 26, wherein the hole is configured to engage the load cell pin in a three-point loading arrangement.

31. The combination of claim 26, wherein the load cell pin is removably mounted in the hole.

32. The combination of claim 26, further comprising means for unroading the load cell pin.

33. The combination of claim 32, wherein the unloading means comprises at least one piston which is positioned in the insert and which in operation forces a portion of the insert that is located above the load cell pin apart from a portion of the insert that is located below the load cell pin.

34. The combination of claim 25, wherein the load sensing means comprises at least one strain gage which is mounted to the insert.

35. The combination of claim 34, wherein the load sensing means comprises at least two strain gages, each of which is mounted adjacent an opposite end of an elongated portion of the insert which comprises a constant cross section.

36. The combination of claim 35, wherein the load sensing means comprises at least four strain gages, each of which is mounted to a respective side of the insert adjacent an opposite end of the elongated portion.

37. The combination of claim 35, wherein each strain gage is mounted in a corresponding relief groove which is formed in a side of the insert.

38. The combination of claim 35, wherein the trunnion block rocker or the stopper block rocker is configured such that the elongated portion is placed in three-point loading.

39. In combination with a floating vessel which includes at least one mooring line for securing the vessel to the sea floor, the improvement comprising a support assembly for the mooring line which comprises:

a trunnion block which is pivotally supported on the vessel about a first axis, the trunnion block comprising an opening through which the mooring line passes and two trunnion block rockers which are located on opposite sides of the opening;

a stopper block which is pivotally supported on the trunnion block about a second axis that is oriented at an angle relative to the first axis, the stopper block comprising a through bore through which the mooring line passes and two stopper block rockers which are located on opposite sides of the through bore opposite the trunnion block rockers;

wherein each of the trunnion block rockers comprises a first surface and each of the stopper block rockers comprises a second surface;

wherein one of the first and second surfaces comprises a convex surface and the other of the first and second surfaces comprises a concave surface; and wherein the convex surfaces engage the concave surfaces to thereby pivotally support the stopper block on the trunnion block.

40. The combination of claim 39, wherein the convex surface comprises a first radius, the concave surface comprises a second radius, and the second radius is greater than the first radius.

41. The combination of claim 40, wherein the second radius is greater than the first radius by a ratio of about 2.0 or more.

42. The combination of claim 39, wherein the support assembly further comprises means for sensing a load on the mooring line.

43. The combination of claim 42, wherein the load sensing means comprises at least one load cell pin which is positioned in a corresponding hole in one of the trunnion block rockers or the stopper block rockers.

44. The combination of claim 43, wherein the load sensing means comprises two load cell pins which are positioned in corresponding holes in one of the trunnion block rockers or the stopper block rockers.

45. The combination of claim 44, wherein the holes are positioned such that a resultant force vector which is representative of the load passes between the load cell pins.

46. The combination of claim 44, further comprising a relief groove which extends through the tninnlon block rocker or the stopper block rocker between the holes.

47. The combination of claim 43, wherein the hole is configured to engage the load cell pin in a three-point loading arrangement.

48. The combination of claim 43, wherein the load cell pin is removably mounted in the hole.

49. The combination of claim 43, further comprising means for unloading the load cell pin.

50. The combination of claim 49, wherein the unloading means comprises at least one piston which in operation forces a portion of the trunnion block rocker or the stopper block rocker that is located above the load cell pin apart from a portion of the trunnion block rocker or the stopper block rocker that is located below the load cell pin.

51. The combination of claim 42, wherein the load sensing means comprises at least one strain gage which is mounted to at least one of the trunnion block rockers and the stopper block rockers.

52. The combination of claim 51, wherein the load sensing means comprises at least two strain gages, each of which is mounted adjacent an opposite end of an elongated portion of the trunnion block rocker or the stopper block rocker which comprises a constant cross section.

53. The combination of claim 52, wherein the load sensing means comprises at least four strain gages, each of which is mounted to a respective side of the trunnion block rocker or the stopper block rocker adjacent an opposite end of the elongated portion.

54. The combination of claim 52, wherein each strain gage is mounted in a corresponding relief groove which is formed in a side of the trunnion block rocker or the stopper block rocker.

55. The combination of claim 52, wherein the trunnion block rocker or the stopper block rocker is configured such that the elongated portion is placed in three-point loading.

56. The combination of claim 39, wherein at least one of the trunnion block rockers and the stopper block rockers comprises a separate insert which is received in a corresponding pocket in the trunnion block or the stopper block.

57. The combination of claim 56, wherein at least each of the trunnion block rockers or each of the stopper block rockers compnses a separate Insert which is received in a corresponding pocket in the trunnion block or the stopper block.

58. The combination of claim 56, wherein each of the trunnion block rockers comprises a separate insert which is received in a corresponding pocket in the trunnion block and each of the stopper block rockers comprises a separate insert which is received in a corresponding pocket in the stopper block.

59. The combination of claim 56, wherein the support assembly further comprises means for sensing a load on the mooring line.

60. The combination of claim 59, wherein the load sensing means comprises at least one load cell pin which is mounted in a corresponding hole in the insert.

61. The combination of claim 60, wherein the load sensing means comprises two load cell pins which are mounted in corresponding holes in the insert.

62. The combination of claim 61, wherein the holes are positioned such that a resultant force vector which is representative of the load passes between the load cell pins.

63. The combination of claim 61, further comprising a relief groove which extends through the insert between the holes.

64. The combination of claim 60, wherein the hole is configured to engage the load cell pin in a three-point loading arrangement.

65. The combination of claim 60, wherein the load cell pin is removably mounted in the hole.

66. The combination of claim 60, further comprising means for unloading the load cell pin.

67. The combination of claim 66, wherein the unloading means comprises at least one piston which is positioned in the insert and which in operation forces a portion of the insert that is located above the load cell pin apart from a portion of the insert that is located below the load cell pin.

68. The combination of claim 59, wherein the load sensing means comprises at least one strain gage which is mounted to the insert.

69. The combination of claim 68, wherein the load sensing means comprises at least two strain gages, each of which is mounted adjacent an opposite end of an elongated portion of the insert which comprises a constant cross section.

70. The combination of claim 69, wherein the load sensing means comprises at least four strain gages, each of which is mounted to a respective side of the insert adjacent an opposite end of the elongated portion.

71. The combination of claim 69, wherein each strain gage is mounted in a corresponding relief groove which is formed in a side of the insert.

72. The combination of claim 69, wherein the insert is configured such that the elongated portion is placed in three-point loading.

* * * * *